United States Patent [19]

Pettinger

[11] 4,108,341

[45] Aug. 22, 1978

[54] CARRYING BELT FOR BATTERIES

[76] Inventor: Siegfried Pettinger, 50, Leutstettenerstrasse 50, 813 Starnberg, Fed. Rep. of Germany

[21] Appl. No.: 652,975

[22] Filed: Jan. 28, 1976

[51] Int. Cl.[2] ..... A45F 5/00

[52] U.S. Cl. ..... 224/5 H; 219/211; 224/26 R; 307/150; 320/2

[58] Field of Search ..... 224/5 R, 5 D, 5 H, 26 R, 224/26 B; 206/328, 329, 332, 333; 136/181; 320/2; 307/150; 150/52 R; 429/99, 100; 219/211; 325/16, 118

[56] References Cited

U.S. PATENT DOCUMENTS

| | | | |
|---|---|---|---|
| 2,304,367 | 12/1942 | Meyer et al. | 224/5 H |
| 2,692,326 | 10/1954 | Crowell | 219/211 |
| 3,274,476 | 9/1966 | Wildum | 224/5 R X |
| 3,407,818 | 10/1968 | Costanzo | 219/211 X |
| 3,664,560 | 5/1972 | Perkins | 224/5 R |
| 3,701,016 | 10/1972 | Bennet et al. | 325/16 |
| 3,887,394 | 6/1975 | Kaye | 429/99 |
| 3,919,615 | 11/1975 | Niecke | 224/5 H X |

FOREIGN PATENT DOCUMENTS

| | | | |
|---|---|---|---|
| 806,000 | 6/1951 | Fed. Rep. of Germany | 150/152 R |
| 7,323 of | 1909 | United Kingdom | 224/5 D |

*Primary Examiner*—Trygve M. Blix
*Assistant Examiner*—Winston H. Douglas
*Attorney, Agent, or Firm*—Erwin S. Teltscher

[57] ABSTRACT

A carrier belt for electrical batteries is usable as a portable current source. The belt has a buckle, a tongue and at least one compartment on the outside thereof for receiving at least one object; the compartment includes a carrier plate attached to the belt, and a protective cover attached to the carrier plate. The carrier plate and the protective cover are made of material which is relatively stiff with respect to the belt.

2 Claims, 2 Drawing Figures

CARRYING BELT FOR BATTERIES

BACKGROUND OF THE INVENTION

1. Field of the Invention

The invention relates to a carrying belt for objects, such as electrical batteries, for use as a portable current source and includes a belt having a buckle and a closure tongue, which has on the outer side thereof at least one compartment for receiving the objects.

2. Description of the Prior Art

A carrying belt having several compartments for receiving of objects, particularly batteries, is known from the German Pat. No. 1,264,001. In this known belt, the compartments are formed by a band of synthetic plastic material having rim segments folded over the longitudinal edges of the belt and removably joinable on the inner side of the belt by a zipper. In order for a belt of this type to be handled adequately, the band of synthetic plastic material which surrounds the belt and forms the compartment must be flexible. This, however, leads to the compartments not being adequately stiff or rigid and therefore easily subject to damage when used and transported, as has been shown in practice.

SUMMARY OF THE INVENTION

It is therefore an objective of the present invention to create a carrying belt having a high resistance to wear.

This objective is attained, according to the present invention, by the compartment consisting of a carrier plate and of a protective cap of relatively stiff material, such as synthetic plastics, the carrier plate and the protective cap being attached to the belt and the carrier plate, respectively.

In a belt of this type it is possible to fabricate a synthetic plastic-material cover for protecting the belt from a relatively flexible material, and to fabricate the synthetic plastic-material carrier plate and the synthetic plastic-material protective plate from a relatively stiff material. The required capability to handle the carrier belt remains unimpaired thereby, while the compartments required to receive the objects may simultaneously be adequately rigid.

The belt is therefore advantageously surrounded by the protective cover, the compartment being attached to the outer side thereof. The fabrication of a carrier belt having a plurality of compartments is facilitated by the same protective cover being suitable for differing numbers of compartments, since differing numbers of compartments can be attached to the protective cover or to the belt, if this is required.

To ensure adequate support of the objects in the compartment, the carrier plate is preferably formed with recesses for receiving the objects, and a pillow of foamed plastic material is disposed between the objects and the protective cap which is so proportioned that the protective cap presses the objects against the carrier plate.

If the objects are batteries, their connection leads can be passed through openings formed in the carrier plate, the protective cover and the belt to the internal or underside of the latter.

BRIEF DESCRIPTION OF THE DRAWING

My invention will be better understood with reference to the accompanying drawing, in which.

DESCRIPTION OF THE PREFERRED EMBODIMENT

Figure 1:
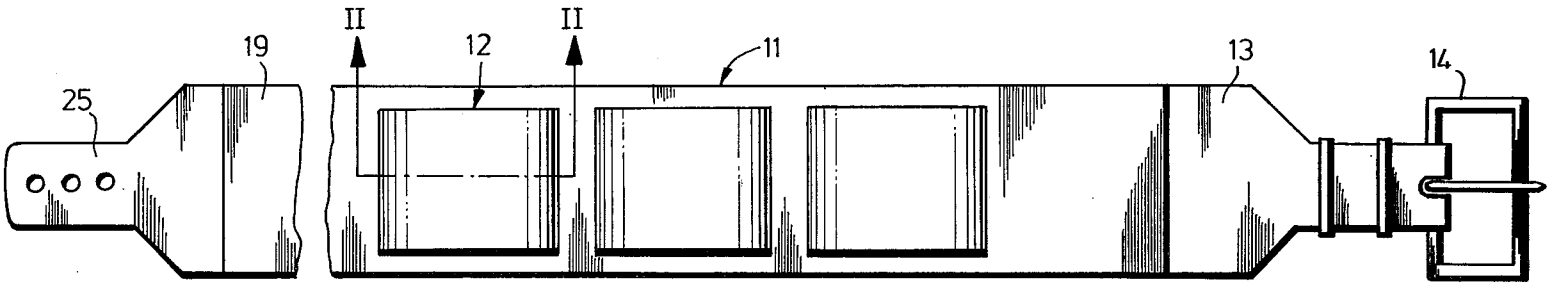
FIG. 1 shows a plan view of the carrier belt, according to the present invention.

The implementation example of the carrier belt 11 includes, according to the invention, several compartments 12, which are disposed on a protective cover 19 of synthetic plastic material, which surrounds a belt 13 of synthetic plastic material having a buckle 14 and a closure tongue 25.

Figure 2:
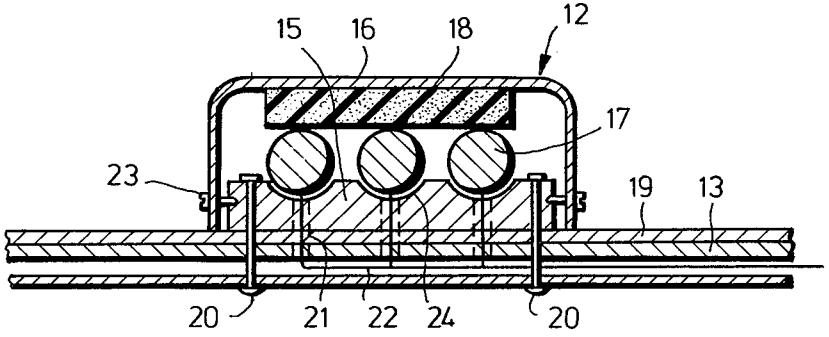
FIG. 2 shows a section along the line II—II of FIG. 1.

As shown in FIG. 2, the compartments 12 consist of a carrier plate 15 of synthetic plastic material having a protective cap 16 of synthetic plastic material. The carrier plate 15 is attached by means of rivets 20 to the protective cover 19 and to the belt 13. The carrier plate 15 is formed with recesses 24 for receiving of objects 17 in the form of batteries. A pillow 18 of synthetic plastic material is disposed between the batteries 17 and the protective cap 16 in order to press the batteries 17 into the recesses 24 and to return them therein. The protective cover 16 is removably attached to the carrier plate 15 by means of screws 23. Recesses 21 are formed in the carrier plate 15, the protective cover 19 and the belt 13, through which there pass leads 22 for connection of the battery or batteries to the internal or underside of the belt 13.

One of the compartments 12 can be so formed that it is suitable for receiving a non-illustrated charging device for the charging of all batteries contained in the belt, a socket for connection of the charging device, and a fuse. The charging apparatus can be attached to the compartment 12 in such a manner that the housing thereof is firmly attached to, and grippingly extends over the protective cap 16 of the compartment 12.

Although the invention has been described with respect to a preferred form thereof, it is to be understood that it is not to be so limited since changes can be made therein which are within the full intended scope of this invention as defined in the appended claims.

What is claimed is:

1. A carrier belt made of synthetic plastic material and having a predetermined width, adapted for use with an electrical battery or the like, the belt being usable as a portable current source and having external and internal sides, a buckle, a tongue and at least one compartment on the outside thereof for receiving at least the one electrical battery or the like, the compartment having a width smaller than said predetermined width, the compartment comprising:

a carrier plate formed with at least one recess for receiving the electrical battery or the like, said carrier plate being attached to the belt;

a protective cap attached to said carrier plate;

a pillow of foamed plastic synthetic material disposed between the electrical battery or the like and said protective cap for pressing the electrical battery or the like against said carrier plate and for retaining the electrical battery or the like in said recess;

a protective cover of synthetic and flexible plastic material surrounding the belt, said cover being internal and external sides, the compartment being attached to the external side of said protective cover;

fastening means for attaching said protective cover to said carrier plate;

lead means attachable to the electrical battery or the like, and wherein said carrier plate, said protective cover, and the belt are formed with a first set of openings, respectively, for passage of said lead means to the internal side of the belt, and wherein said protective cover and the belt are formed with a second set of openings, respectively, said carrier plate and said protective cap being made of a material relatively stiff with respect to the belt; and rivet means passing through said second set of openings for attaching said carrier plate to the belt.

2. A carrier belt as claimed in claim 1 wherein said carrier plate is formed with a plurality of recesses for receiving a plurality of batteries, respectively, the batteries being connectable to one another.

* * * * *